US008499410B2

(12) United States Patent
Yoshimura et al.

(10) Patent No.: US 8,499,410 B2
(45) Date of Patent: Aug. 6, 2013

(54) DEPOSIT REMOVING DEVICE

(75) Inventors: Shoji Yoshimura, Takasago (JP); Kenichi Uesugi, Takasago (JP); Taisuke Miyazono, Takasago (JP); Koichi Honke, Kobe (JP); Toru Okada, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 1658 days.

(21) Appl. No.: 11/570,058

(22) PCT Filed: Aug. 2, 2005

(86) PCT No.: PCT/JP2005/014099

§ 371 (c)(1),
(2), (4) Date: Dec. 5, 2006

(87) PCT Pub. No.: WO2006/013848

PCT Pub. Date: Feb. 9, 2006

(65) Prior Publication Data

US 2008/0023051 A1 Jan. 31, 2008

(30) Foreign Application Priority Data

Aug. 5, 2004 (JP) ..... 2004-229468

(51) Int. Cl.
*B08B 5/00* (2006.01)

(52) U.S. Cl.
USPC ..... 15/309.1; 15/316.1; 15/415.1

(58) Field of Classification Search
USPC ..... 15/316.1, 301–303, 306.1, 309.1, 15/309.2, 312.1, 312.2, 314, 318, 318.1, 15/415.1
See application file for complete search history.

(56) References Cited

U.S. PATENT DOCUMENTS

| | | | | | |
|---|---|---|---|---|---|
| 1,739,593 | A | * | 12/1929 | Giles et al. | 15/309.1 |
| 3,040,361 | A | * | 6/1962 | Baumbach | 15/316.1 |
| 4,026,701 | A | * | 5/1977 | Till et al. | 430/119.8 |
| 4,044,420 | A | * | 8/1977 | Hanson | 15/304 |
| 4,413,784 | A | * | 11/1983 | Dea | 239/426 |
| 4,557,241 | A | * | 12/1985 | Kawachi et al. | 123/585 |
| 4,942,982 | A | * | 7/1990 | Hartwigsen et al. | 222/195 |
| 5,254,166 | A | * | 10/1993 | Tu | 118/63 |
| 5,313,685 | A | | 5/1994 | Kramer et al. | |
| 5,423,917 | A | * | 6/1995 | Garcia, Jr. | 134/1 |
| 5,584,939 | A | * | 12/1996 | Dahlin et al. | 134/7 |

(Continued)

FOREIGN PATENT DOCUMENTS

| | | | |
|---|---|---|---|
| DE | 4016089 | * | 11/1991 |
| DE | 4305907 | * | 8/1994 |

(Continued)

*Primary Examiner* — Mark Spisich
(74) *Attorney, Agent, or Firm* — Oblon, Spivak, McClelland & Neustadt, L.L.P.

(57) ABSTRACT

A deposit removing device capable of efficiently removing deposit on a plate-like member such as a metal plate or resin plate by reducing a spacing distance between the plate-like member and an injection nozzle, and also capable of coping with the removal of deposit on the plate-like member rolled or conveyed at a high speed. This deposit removing device removes the deposit adhered to the plate-like member (T) by jetting compressed air from at least one jetting hole (101) of a nozzle body (100) in which the at least one jetting hole (101) is formed. This device is configured so that the nozzle body (100) is supported so as to be movable in a direction (W1) substantially perpendicular to the surfaces (T1 and T2) of the plate-like member (T).

15 Claims, 8 Drawing Sheets

U.S. PATENT DOCUMENTS

| | | | | | |
|---|---|---|---|---|---|
| 5,649,338 | A | * | 7/1997 | Kato | 15/304 |
| 5,989,344 | A | * | 11/1999 | Platsch | 118/684 |
| 6,357,669 | B1 | * | 3/2002 | Goenka et al. | 239/8 |
| 6,415,993 | B1 | * | 7/2002 | Forbert et al. | 239/434 |
| 6,630,032 | B2 | * | 10/2003 | Carmi et al. | 134/1 |
| 6,834,521 | B1 | * | 12/2004 | Denker et al. | 72/39 |
| 6,863,225 | B2 | * | 3/2005 | Nakamura | 239/105 |

FOREIGN PATENT DOCUMENTS

| | | | | |
|---|---|---|---|---|
| EP | 0 513 632 | A1 | | 11/1992 |
| JP | 7-6374 | | | 1/1995 |
| JP | 10 8276 | | | 1/1998 |
| JP | 10 12581 | | | 1/1998 |
| JP | 10 146611 | | | 6/1998 |
| JP | 10-211473 | | * | 8/1998 |
| JP | 10-277628 | | * | 10/1998 |
| JP | 10-291022 | | * | 11/1998 |
| JP | 11-235559 | | * | 8/1999 |
| JP | 11-277011 | | * | 10/1999 |
| JP | 11-314115 | | * | 11/1999 |
| JP | 11-319741 | | * | 11/1999 |
| JP | 2000-105078 | | * | 4/2000 |
| JP | 2001 196345 | | | 7/2001 |
| JP | 2001-250802 | | * | 9/2001 |
| JP | 2002-282803 | | * | 10/2002 |
| JP | 2002-361191 | | * | 12/2002 |
| JP | 2004 167494 | | | 6/2004 |
| KR | 10-1990-0009117 | | | 7/1990 |
| WO | 97/49507 | | * | 12/1997 |

* cited by examiner

DEPOSIT REMOVING DEVICE

TECHNICAL FIELD

The present invention relates to a deposit removing device for removing an oil component such as rolling oil adhered to a plate-like member and/or a liquid such as a cleaning liquid for cleaning the plate-like member. More specifically, the present invention relates to a deposit removing device for removing the above-described deposit by blowing compressed air on the plate-like member.

BACKGROUND ART

In general, when rolling a metal plate or resin plate by a rolling machine, rolling oil is supplied to a rolling contact portion between a work roll (mill roll) and the plate-like member, in order to cool the work roll or the plate-like member rolled by the work roll, or to improve rolling efficiency. Also, when it is necessary to clean soils or oxide films off the surfaces of the plate-like member, the plate-like member is passed through a cleaning tank that contains cleaning liquid.

Since the rolling oil and/or cleaning liquid thus adheres to the plate-like member after rolling, the rolling oil and/or cleaning liquid must be removed before the plate-like member is rolled up by a rolling-up device. This is because, if the plate-like member is rolled up with the rolling oil adhered thereto, the friction coefficient between the contact surfaces between plate-like member portions that have been rolled up decreases, so that there arises a problem in that the plate-like member may slide sideways along the direction of its width to thereby collide against the rolling-up device, or the plate-like member itself may rupture. Also, if the plate-like member (rolling coil) that has been rolled up with the rolling oil unsatisfactorily removed, is annealed at a subsequent process, there may occur a problem of causing local nonuniformity in annealing result, leading to a reduction in product quality. Furthermore, if the plate-like member is stored with the cleaning liquid adhered thereto, there may arise a problem of the plate-like member being corroded by the cleaning liquid.

Hitherto, a large number of methods for removing rolling oils or cleaning liquids have been proposed. For example, there are known methods in which rolling oil or cleaning liquid adhered to the plate-like member is scraped off or squeezed by means of a pair of rollers made of steel, rubber wiper of which the surface is covered with an elastic body such as rubber, a pair of rubber rollers, or a pair of porous rollers of which the surface is covered with a porous material such as nonwoven fabric. Also, as set forth in Patent Documents 1 and 2, there is another known method in which deposit such as rolling oil or cleaning liquid is blown off by jetting compressed air from a jetting nozzle toward a plate-like member.

Patent Document 1: Japanese Unexamined Patent Application Publication No. 10-8276

Patent Document 2: Japanese Unexamined Patent Application Publication No. 10-146611

However, since the above-described method for removing deposit using the rubber wiper or one of the pair of rollers makes the roller pair and the plate-like member contact with each other, there is a possibility that contact damage such as scratches may occur on the surfaces of the plate-like member. Especially when the pair of rubber rollers or pair of steel rollers is used, the deposit removing effect increases as the pressing force on the plate-like member increases, but on the other hand, the plate-like member becomes more susceptible to the contact damage. Such a problem becomes more serious as the plate-like member becomes thinner, and in some cases, it may lead to even rupture of the plate-like member.

Also, when the above-described porous rollers are used, the contact damage is a little reduced, compared with the rubber wiper, the pair of rubber rollers, or the pair of steel rollers. However, not only the deposit removing effect is reduced by hole clogging on the roller surface, but also there is inconvenience of having to perform maintenance work for eliminating hole logging.

On the other hand, because the method set forth in the above-described Patent Documents 1 and 2 is one for removing deposit in a noncontact manner, there is no possibility of causing a problem of incurring contact damage. However, because a jetting nozzle and the surface of a rolled plate are arranged apart from each other by about several millimeters to several tens of millimeters, there is a problem in that the jetting energy (jetting pressure) of air is dispersed and a sufficient deposit removing effect cannot be obtained.

Of course, if the compression pressure of compressed air to be supplied to the jetting nozzle is set to a higher pressure, the deposit removing effect would be enhanced, but the compressor for producing compressed air, air tank for storing compressed air or the like is upsized, and further, air piping and the like is forced to have a high resistance, which is undesirable from economical and practical viewpoints.

If the jetting nozzle can be brought as close to the surface of the plate-like member as possible, the dispersion of injection energy of air can be prevented to thereby efficiently remove deposit. However, if the jetting nozzle is brought too close to the surface of the plate-like member, there occurs a possibility that the plate-like member may be damaged from vibrations during rolling, vibrations during the conveyance of the plate-like member, or warpage of the plate-like member. For this reason, it has hitherto been difficult to bring the jetting nozzle close to the surface of the rolled plate within a range of several millimeters.

In recent years, in which the rolling speed (conveying speed) is becoming increasingly faster (about 800 m/min or more), even if any one of the above-described deposit removing methods is used, it would be impossible to efficiently and effectively remove deposit on the plate-like member rolled or conveyed at a high speed.

DISCLOSURE OF INVENTION

The present invention has been made in view of the above-described circumstances, and the object thereof is to provide a deposit removing device capable of efficiently removing deposit on the plate-like member such as a metal plate by reducing the spacing distance between the plate-like member and the injection nozzle, and also capable of coping with the removal of deposit on the plate-like member rolled or conveyed at a high speed.

The present invention is incorporated into the deposit removing device that removes deposit adhered to the plate-like member by jetting compressed gas from a jetting hole of a nozzle body in which the jetting hole is formed. This deposit removing device is configured so that the nozzle body is supported so as to be movable in a direction substantially perpendicular to the surfaces of the plate-like member. By causing the nozzle body to follow undulations of the plate-like member and moving it, it is possible to maintain the nozzle body in a state of being always spaced apart from the plate-like member by a substantially fixed distance.

BEST MODE FOR CARRYING OUT THE INVENTION

Figure 1:
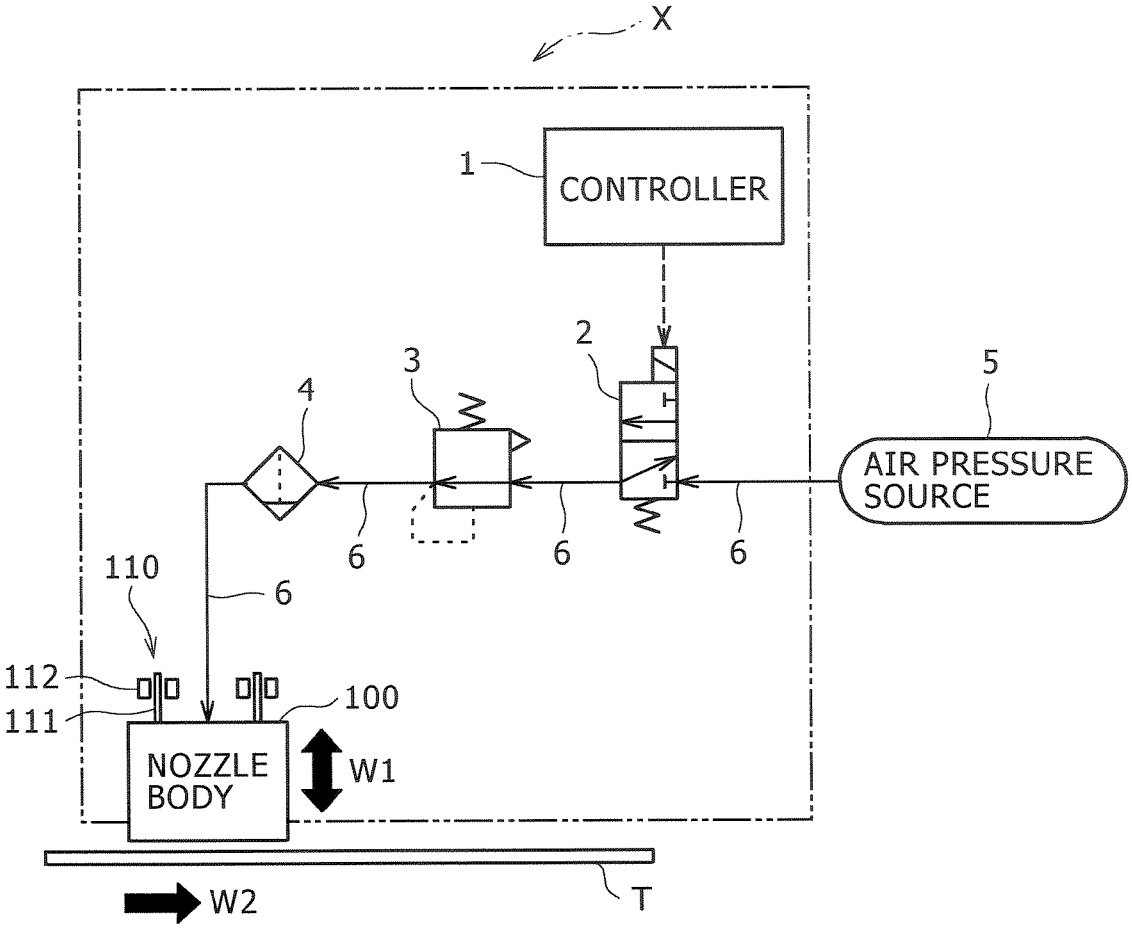
FIG. 1 is a circuit diagram showing an outline of an air control system in a deposit removing device according to an embodiment of the present invention.

Hereinafter, an embodiment and examples according to the present invention are described with reference to the accompanying drawings in order to provide a clear understanding of the present invention. The following embodiment and examples are only instances in which the present invention has been embodied, and do not limit the technical scope of the present invention.

The present invention is incorporated into the deposit removing device that removes deposit adhered to the plate-like member by jetting compressed gas from a jetting hole of a nozzle body in which the jetting hole is formed, the deposit removing device being configured so that the nozzle body is supported so as to be movable in a direction substantially perpendicular to the surfaces of the plate-like member.

With such an arrangement, the present invention allows the nozzle body to float in a state of being always spaced apart from the plate-like member by a substantially fixed distance. For example, when the above-described nozzle body is located on the top surface side of the plate-like member, the nozzle body floats in a state of being spaced apart from the plate-like member by a substantially fixed distance. By virtue of this arrangement, even if the surface of the plate-like member are moved up and down by vibrations occurring to the plate-like member or deformation, such as warpage, of the plate-like member, the nozzle body moves up and down following the up-and-down movements of the plate-like member, so that the spacing distance from the surface of the plate-like member to the nozzle body are always kept at a fixed value. As a result, it is possible to set the distance between the plate-like member and the nozzle body to several millimeters or less, and specifically, to be on the level of 0.1 millimeters. Hitherto, because the spacing distance has been set to several millimeters, a sufficient deposit removing effect has not been obtainable unless compressed gas with a relatively high pressure is supplied. However, according to the present invention, by further reducing the spacing distance, it is possible to obtain the deposit reducing effect that is equivalent to or larger than the conventional deposit removing device, even using compressed gas with a lower pressure. Especially when a plurality of the jetting ports are used, a plurality of acting forces on the nozzle body due to the jetting pressure of compressed gas strike balance therebetween, so that this balance allows the nozzle body to more stably float in a state of being always spaced apart from the plate-like member by a substantially fixed distance.

Also, by reducing the distance between the plate-like member and the nozzle body, the jetting pressure of compressed gas jetted to the plate-like member increases, which makes is possible to remove deposit on the plate-like member rolled by a rolling machine at high speed, i.e., the plate-like member conveyed at a high speed.

It is preferable that the total area of the jetting port be formed so as to be two third the area of the opposed surface. This is a most preferable condition for levitating the nozzle body by the jetting pressure of compressed air and stably maintaining the nozzle body at the levitated position. This condition has been found from the experimental results obtained by the inventors of the present invention.

Possible jetting ports formed in the opposed surface of the nozzle body may include such ones that are arranged at spacings in a direction substantially perpendicular to the conveying direction of the plate-like member and the moving direction.

Also, in the opposed surface of the nozzle body, providing a planar nozzle having a long opening in the direction substantially perpendicular to the conveying direction of the plate-like member and the moving direction of the nozzle body, allows compressed gas to be uniformly jetted across the full width of the plate-like member.

Furthermore, in order to easily separate the nozzle body from the plate-like member, it is preferable that the main material constituting the nozzle body be a lightweight material such as a plastic material.

Moreover, in order to make removable deposit on the surface both on the top surface side and bottom surface side of the plate-like member, it is preferable that the nozzle body be arranged on the surface either one of the top surface side or bottom surface side of the plate-like member, or the nozzle bodies be arranged on both surfaces.

Furthermore, it is preferable that the nozzle body be elastically supported. Thereby, when the nozzle body is disposed on the bottom surface side of the plate-like member, it is possible to hold the nozzle body in a state of being always spaced apart from the plate-like member by a substantially fixed distance by a balance between the jetting pressure of compresses air and an elastic energization force acting on the plate-like member.

Also, configuring the nozzle bodies provided both on the top side and bottom side of the plate-like member to be elastically supported, allows the nozzle body to be prevented from overshooting or undershooting in the up-and-down direction, or hunting, even when the plate-like member abruptly fluctuates up and down.

In an aspect of the present invention, a depressed gas-reservoir is provided in the opposed surface, and the nozzle body has a communicating hole for allowing the inside of the gas reservoir to communicate with the outside of the nozzle body. In such an aspect, when compressed gas is jetted to the plate-like member and the gas reflects from the plate-like member to thereby collide the opposed surface, the compressed gas jetted from the jetting port is accumulated inside the gas reservoir, and gas inside the gas reservoir is guided outside the nozzle body through the communicating hole. This makes it possible that the deposit stripped off by the jetting of the compressed gas stays in the gas reservoir, and that the staying air can be discharged to the outside. As a result, in particular, even if the deposit is a viscous material that is prone to adhere to the opposed surface, e.g., a viscous material such as oil or dust containing oil, it is possible to reliably prevent the deposit from colliding against the opposed surface and adhering thereto, and to reduce clogging of the jetting port or re-adhesion of the deposit to the plate-like member.

In this case, providing suction means for sucking gas in the air reservoir through the communicating hole, allows gas that contains deposit to be discharged.

It is preferable that there be provided deposit separating/recovering means for separating and recovering deposit contained in gas discharged from the communicating hole. This eliminates deposit discharged from the communicating hole being dispersed in the air, thereby implementing a deposit removing device that is friendly to human bodies and the environment. It is also prevented that the discharge deposit flutters down on the plate-like member to thereby re-adheres thereto.

Furthermore, the separating/recovering means is deemed to separate and recover liquid deposit alone from the gas that contains deposit. If the liquid deposit is reusable one such as oil or cleaning liquid, it can be exclusively recovered and reused.

The deposit removing device according to another aspect of the present invention includes drive means that is connected to the nozzle body, and that moves the nozzle body in a direction substantially perpendicular to the surface of the plate-like member; and drive control means that moves the nozzle body in a direction away from the plate-like member by drive-controlling the drive means, when the pressure of compressed gas supplied to the nozzle body becomes lower than a specified pressure that has been predetermined. Thereby, even if, e.g., due to failure or the like of a compressed air tank or a pump for feeding the compressed air, the pressure of the compressed air becomes lower than the specified pressure, and compressed air sufficient for floating (levitating) the nozzle body is not supplied, the nozzle body is forcedly separated from the plate-like member before the nozzle body falls down and collides against the plate-like member. Thus, the plate-like member is protected from failure caused by the collision.

Now, the schematic construction of an air control system of the deposit removing device X according to the embodiment of the present invention with reference to a circuit diagram in FIG. 1.

The present deposit removing device X is a device for removing deposit including liquid such as rolling oil or cleaning liquid, or chips adhered to a plate-like member T rolled by a rolling machine or the like and made of a metal or nonmetal. As shown in FIG. 1, this deposit removing device includes a nozzle body 100 that jet compressed air (one example of compressed gas) supplied from the air pressure source 5 to the surface of the plate-like member T; a solenoid valve 2 provided in a pipe line 6 connecting the nozzle body 100 and the air pressure source 5; a pressure reducing valve 3 provided in the pipe line 6 downstream of the solenoid valve 2; an air filter 4 provided downstream of the pressure reducing valve 3; and controller 1 that performs control for switching the route (air path) of compressed air by magnetizing/demagnetizing the solenoid valve 2. In this embodiment, the description is made of the case where compressed air is used as compressed gas, but nitrogen gas, which is low in corrosivity, may be used. The present deposit removing device X is not limited to plate-like members rolled by the above-described rolling machine, but can be applied to all plate-like members.

The above-described controller 1 is configured to include a control unit such as sequencer, and for example, upon detecting a start signal being inputted from the outside, the control unit magnetizes the solenoid valve 2 to thereby switch the solenoid valve 2 from a closed position to open position. Compressed air supplied via the solenoid valve 2 is decompressed to a fixed pressure predetermined by a pressure reducing valve 3, and after having cleared of water vapor and/or dusts by an air filter 4 with a drain, it is supplied to the nozzle body 100.

Figure 2:
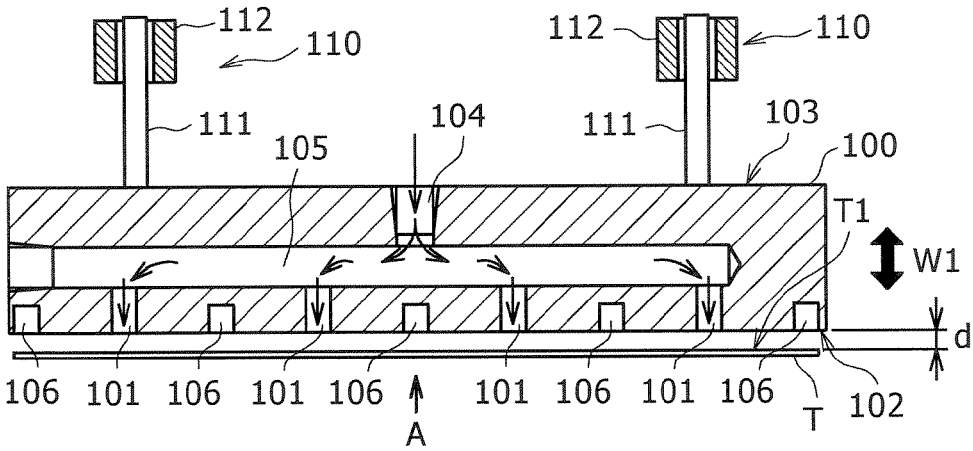
FIG. 2 is a schematic sectional view of a nozzle body along its longitudinal direction.
Figure 3:
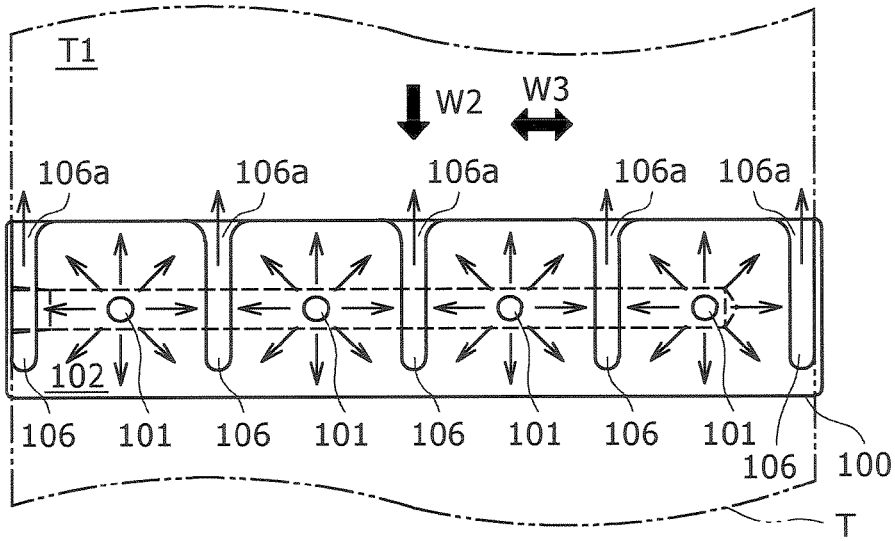
FIG. 3 is an arrow view of the nozzle body as viewed in the direction of A in FIG. 2.
Figure 4:
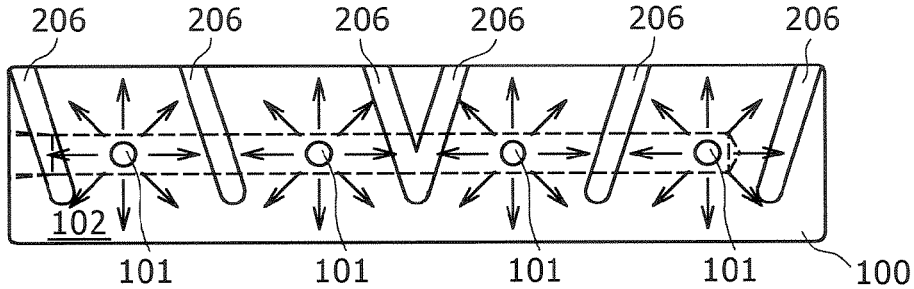
FIG. 4 is a schematic bottom view of a modification of the nozzle body in FIG. 2.

Next, the nozzle body 100 will be described with reference to FIGS. 2 to 4. FIG. 2 is a schematic sectional view of a nozzle body along its longitudinal direction (left-and-right direction in FIG. 2) of the nozzle body 100; FIG. 3 is an arrow view of the nozzle body 100 as viewed in the direction of A in FIG. 2; and FIG. 4 shows a modification of the nozzle body in FIG. 2. In these figures, arrows without symbol each indicate a flow of compressed air.

As shown in FIG. 2, the nozzle body 100 is disposed on the top surface side of the plate-like member T. The nozzle body 100 is formed of a lightweight material such as a plastic material, and has a substantially rectangular parallelepiped shape that is long in the width direction of the plate-like member.

An opposed surface 102 of the nozzle body 100, facing the top surface T1 of the plate-like member T, has four jetting ports 101. These four jetting ports 101 are arranged at spacings (in the illustrated example, at equal spacings) in the direction substantially perpendicular to a moving direction W1 (refer to FIG. 2) of the nozzle body 100 and a conveying direction W2 (refer to FIG. 3) of the plate-like member T. Here, the number of jetting ports is not limited to four, as long as there is provided at least one jetting port.

In the opposed surface 102, a plurality of grooves 106 (in this embodiment, five grooves) in parallel with the conveying direction W2 of the plate-like member T are formed at predetermined spacings, in order to guide the compressed air jetted from the jetting ports 101 to the upstream side of the conveying direction W2 of the plate-like member T, and blow off the deposit that has been stripped off, toward the upstream side in the conveying direction W2. One end 106*a* of the groove 106 on the upstream side in the conveying direction W2 of the plate-like member T is formed into a divergent shape, and opened to the side surface of the conveying direction W2.

In the groove 106 formed parallel to the conveying direction W2, there is a possibility that the stripped-off deposit may be again adhered to the plate-like member T. This being the case, as shown in FIG. 4, it is desirable that, in the opposed surface 102, there be provided grooves 206 each having a tilt angle toward the outside in the width direction of the plate-like member T top surface T1 with respect to the conveying direction W2, unlike the above-described groove 106. Providing such grooves 206 allows the deposit removing efficiency to be improved, because stripped-off deposit is blown off toward the outside in the width direction of the plate-like member T, together with compressed air flowing in the groove 206.

In the surface 103 opposite to the opposed surface 102, there is provided a supply port 104 of compressed air that has been supplied from the air pressure source 5 (FIG. 1), and decompressed to a predetermined pressure by the pressure reducing valve 3. The supply port 104 communicates with a communicating path 105 that allows the jetting ports 101 to communicate with each other inside the communicating path 105. Therefore, when compressed air is supplied into the supply port 104, the compressed air is jetted from the jetting ports 101 to the top surface T1 of the plate-like member T through the communicating path 105.

Also, on the surface 103 of the nozzle body 100, there are provided slide bars 111, and at an upper portion thereof, a slide guide 112 that supports the slide bar 111 so as to be movable vertically is arranged as appropriate. The slide bar 111 and slide guide 112 (hereinafter, these are collectively referred to as a slide mechanism 110) are one example of means for supporting the nozzle body 100 so as to be movable in the direction W1 substantially perpendicular to the top surface T1 of the plate-like member T. Of course, the above-described means is not limited to the slide mechanism 110. For example, the above-described means may include one for elastically supporting the nozzle body 100 so as to be movable in the direction W1 substantially perpendicular to the top surface T1, by using a mechanism (refer to FIG. 16) that supports the nozzle body 100 in a state of being suspended from above by an elastic member such as a coil spring of which one end is fixed, or a mechanism that supports the nozzle body 100 by an elastic member such as leaf springs spanned from the sides of the nozzle body 100 in the longitudinal direction.

Here, the description will be made of operations of the nozzle body 100 when compressed air is supplied to the nozzle body 100 with the above-described arrangement. When compressed air is supplied from the supply port 104, the supplied compressed air is jetted from jetting ports 101 through the communicating path 105 (refer to FIG. 2). The compressed air jetted from the jetting port 101, with its compression pressure released in a stroke, is blown on the top surface T1 of the plate-like member T in a substantially radial manner (refer to FIG. 3).

After the compressed air has been blown on the top surface T1 of the plate-like member T, the pressure of the compressed air acts on the nozzle body 100, as a force attempting to separate the nozzle body 100 from the plate-like member T, namely, a force attempting to boost the nozzle body 100 upward in the moving direction W1. That is, the pressure of the compressed air operates on the nozzle body 100 as the boosting force. Under the action of the boosting force on the nozzle body 100, the nozzle body 100 levitates from the plate-like member T. When the nozzle body 100 levitates under the boosting force, there occurs a gap d between the opposed surface 102 of the nozzle body 100 and the plate-like member T. As a result, an air pressure layer is formed in this gap by a pressure of the air jetted from the nozzle body 100, and thereby, the nozzle body 100 levitates at a position spaced apart from the plate-like member T by a distance of $d_0$. In this embodiment, on a principle described later, the compression pressure of the compressed air is adjusted by the pressure reducing valve 3 so that the nozzle body 100 is levitated from the top surface T1 of the plate-like member T by the distance $d_0$, and that the nozzle body 100 floats at the pertinent position.

The nozzle body 100 is floated by the jetting pressure of the compressed air that is blown on in this manner, and simultaneously, liquid such as rolling oil or cleaning liquid, and chips, soils, or the like that have been adhered to the top surface T1 of the plate-like member T, are stripped off. Also, because the jetted compressed air is let to flow toward the upstream side of the conveying direction W2 of the plate-like member T along the grooves 106, the stripped-off deposit moves with the flow and is blown off toward the upstream side of the conveying direction W2 through the gap between the nozzle body 100 and the top surface T1 of the plate-like member T.

Figure 5:
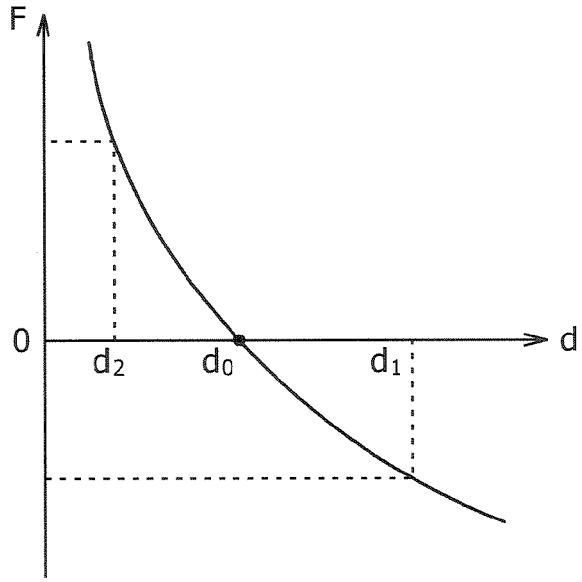
FIG. 5 is a graph showing the relationship between the force on the nozzle body and the spacing distance.
Figure 6:
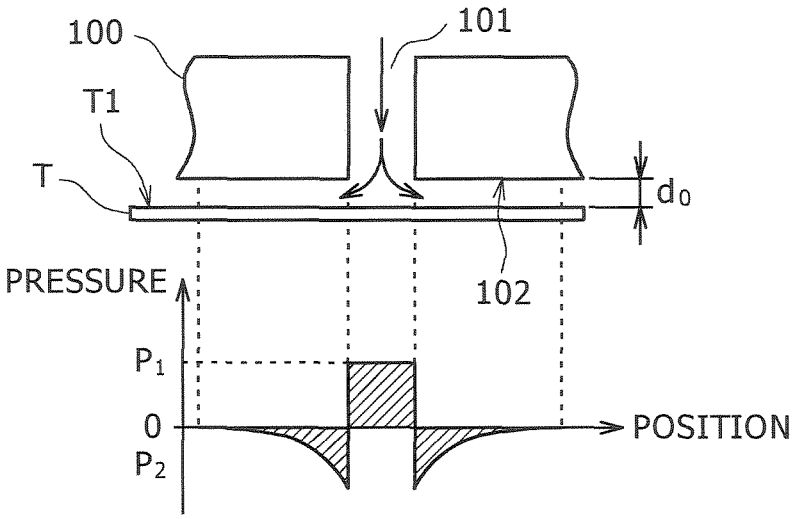
FIG. 6 is a diagram showing a pressure distribution in the vicinity of a jetting port when the spacing distance d is a distance $d_0$.
Figure 7:
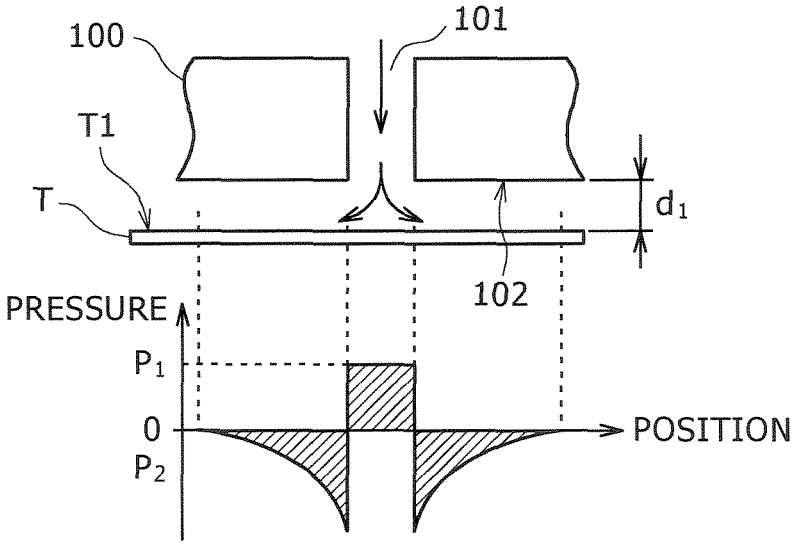
FIG. 7 is a diagram showing a pressure distribution in the vicinity of a jetting port when the spacing distance d is a distance $d_1$ ($>d_0$).
Figure 8:
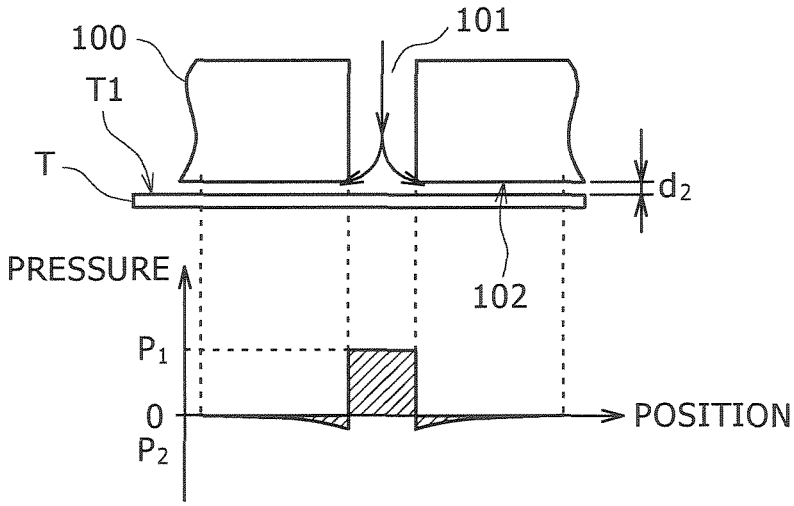
FIG. 8 is a diagram showing a pressure distribution in the vicinity of a jetting port when the spacing distance d is a distance $d_2$ ($<d_0$).

Next, the relationship between the force F (vertical axis; hereinafter referred to as an acting force F) acting on the nozzle body 100, and the spacing distance d (horizontal axis) between the nozzle body 100 and the top surface T1 of the plate-like member T will be described with reference to FIGS. 5, 6, and 8. Here, FIG. 5 is a graph showing the relationship between the acting force F on the nozzle body and the spacing distance d. FIGS. 6 to 8 are diagrams each showing a pressure distribution in the vicinity of the jetting port 101, wherein FIG. 6 shows a pressure distribution when the spacing distance d is a distance $d_0$; FIG. 7 shows a pressure distribution when the spacing distance d is a distance $d_1$ ($>d_0$); and FIG. 8 shows a pressure distribution when the spacing distance d is a distance $d_2$ ($<d_0$) It is here assumed that the acting force F includes the boosting force attempting to boost the nozzle body 100 upward in the moving direction W1 by the jetting pressure of compressed air, and as described later, an adsorption force attempting to cause the nozzle body 100 to adsorb to the plate-like member T. For convenience of description, the weight of the nozzle body 100 is neglected.

As can be seen from the graph in FIG. 5, when the spacing distance d is the $d_0$, the acting force F is 0. At this time, as shown in FIG. 6, the integrated value (i.e., boosting force) of a boosting pressure $P_1$ attempting to boost the nozzle body 100 by the jetting pressure of compressed air, and the integrated value (i.e., adsorption force) of an adsorption pressure $P_2$ attempting to cause the nozzle body 100 to adsorb to the plate-like member T are kept in balance, so that the nozzle body 100 is in a state of being floating at the position spaced apart by the distance $d_0$. Here, the adsorption pressure $P_2$ is a negative pressure occurring when the compressed air flows out from the gap between the nozzle body 100 and the plate-like member T, the negative pressure generating the adsorption force.

When the top surface T1 of the plate-like member T moves downward due to vibrations or the like occurring during the rolling or conveying of the plate-like member T, and the spacing distance d becomes a distance $d_1$, which is larger than the distance $d_0$ (i.e., $d_1>d_0$), the resistance against the flow of compressed air in the space corresponding to the spacing distance d decreases, so that the compressed air becomes easy to escape, leading to an increase in the flow speed of flowing-out air. As a consequence, as shown in FIG. 7, the adsorption pressure $P_2$ increases/and the adsorption force surpasses the boosting pressure. By this adsorption force, the nozzle body 100 moves downward, and the spacing distance d is reduced from the distance $d_1$ to the distance $d_0$. Therefore, even when the top surface T1 of the plate-like member T moves downward, the nozzle body 100 restores the above-described balancing state at once, thus keeping floating at the position spaced apart by the distance $d_0$.

On the other hand, when the spacing distance d becomes a distance $d_2$ that is smaller than the distance $d_0$ (i.e., $d_2<d_0$), contrary to the foregoing, the resistance against the flow of compressed air in the space corresponding to the spacing distance d increases, so that the compressed air becomes difficult to escape, leading to an decrease in the flow speed of flowing-out air. As a consequence, as shown in FIG. 8, the adsorption pressure $P_2$ decreases, and the boosting pressure surpasses the adsorption force. By this boosting force, the nozzle body 100 moves upward, and the spacing distance d is increased from the distance d2 to the distance $d_0$. Therefore, even in this case, the nozzle body 100 restores the above-described balancing state at once.

In this way, in the present deposit removing device X, even if the top surface T1 of the plate-like member T moves up and down, the nozzle body 100 moves up and down following the up-and-down moving of the top surface T1, and therefore, the spacing distance d from the top surface T1 of the plate-like member T to the nozzle body 100 is always kept at a fixed value. That is, even if the plate-like member T vibrates, the fixed spacing distance is maintained. Hence, even if the spacing distance d is set to a distance $d_0$ that is as close as possible to zero, e.g., 0.1 mm, there is no possibility that the nozzle body 100 may make contact with the plate-like member T, and that the plate-like member T is suffer damage as a result of the above-described contact.

When the plate-like member T abruptly moves up and down, the nozzle body 100 also abruptly moves up and down following the up-and-down moving of the top surface T1, and therefore, there is an apprehension that the nozzle body 100 may overshoot or undershoot in the up-and-down direction. Furthermore, these overshoot and undershoot may periodically occur to thereby cause hunting of the nozzle body 100. Therefore, in order to prevent the overshoot, hunting, or the like, it is desirable for the nozzle body 100 to be elastically supported by elastic members such as springs. Possible concrete countermeasures include a method of interposing helical springs to the slide bars 111, or a method using slide bars 111 constituted of damping members such as oil dampers.

Meanwhile, the opening area of each of the jetting ports 101 formed in the opposed surface 102 of the nozzle body 100 and the area of the opposed surface 102 constitute important elements in levitating the nozzle body 100. The reason for that is described below with reference to FIGS. 6 to 8. Here, for convenience of explanation, the weight of the nozzle body 100 is neglected, as well.

As shown in FIG. 7, when the spacing distance d increases, as described above, the resistance against the flow of compressed air in the space corresponding to the spacing distance d decreases, so that the flow rate of flowing-out air increases. As a consequence, the adsorption pressure $P_2$ (negative pressure) occurs with respect to the opposed surface 102 of the nozzle body 100 (especially with respect to the peripheral portion of the jetting port 101). This adsorption pressure $P_2$ works as a force attempting to cause the nozzle body 100 to adsorb to the plate-like member T. Here, let the boosting pressure $P_1$ attempting to boost the nozzle body 100 by the jetting pressure of compressed air be $P_1$ (>0); the adsorption pressure $P_2$ (<0); the sum of the opening areas of all jetting ports be $S_1$; the sum of the areas in the opposed surface 102 of the nozzle body 100, on which areas the adsorption pressure $P_2$ acts, be $S_2$. Then, if a condition: $(P_1\times S_1)+(P_2\times S_2)<0$ is satisfied, the adsorption force attempting to cause the nozzle body 100 to adsorb to the plate-like member T surpasses the boosting pressure attempting to boost the nozzle body 100. As a result, the nozzle body 100 is moved downward. Therefore, in order to float the nozzle body 100 with the distance d0 maintained, irrespective of the magnitude of the spacing distance d, it would be suffice only to satisfy a condition: $(P_1\times S_1)>(P_2\times S_2)$. Here, there is a correlation between the jetting pressure $P_1$ and the adsorption pressure $P_2$, and hence, in order to satisfy the above-described condition, it is recommendable to meet the above-described condition by taking the areas $S_1$ and $S_2$ as variable values.

On the other hand, since deposit on the plate-like member T is removed by compressed air flowing on the opposed surface 102 of the nozzle body 100, making the area $S_2$ too small as compared with the $S_1$ makes it difficult to remove deposit, resulting in a reduced deposit reducing effect.

With this being the situation, by repeated experiments and researches, the inventors of this application has found that, as a condition satisfying both of the condition for floating the nozzle body 100 with the distance d0 maintained, and the condition for increasing the deposit reducing effect, the following relation is optimum.

$$S_1<2S_2 \quad (1)$$

Here, letting the area of the opposed surface 102 of the nozzle body 100 be S, this area S can be approximated by S≈S1+S2, and hence the expression (1) can be deformed as below.

$$3S_1<2S \quad (2)$$

That is, if the jetting ports 101 are formed so that the sum of the area of all openings of the jetting ports 101 is smaller than substantially two third the area of the opposed surface 102, the balance between the boosting force and the adsorption force become easy to be struck without being affected by the pressure of compressed air, so that it is possible to cause the nozzle body 100 to stably float following vibrations of the plate-like member T, and to obtain a sufficient deposit removing effect.

In this embodiment, the compressed air pressure to be supplied to nozzle body 100 is adjusted so that the distance $d_0$ becomes 0.1 mm, which is relatively close to 0. The reason why the spacing distance d is thus set to a value close to 0 will be explained below.

Figure 9:
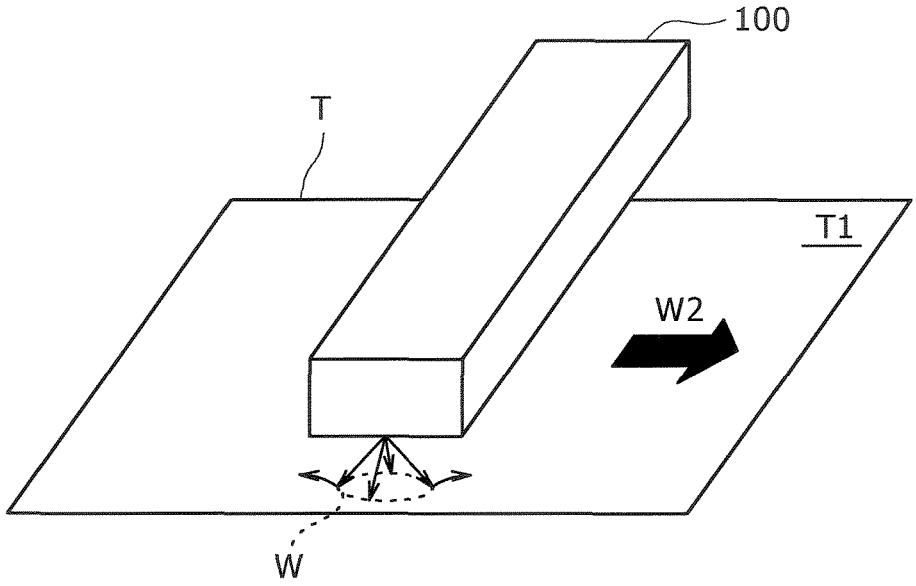
FIG. 9 is a schematic view showing the relationship between the spacing distance and the deposit removing effect.
Figure 10:
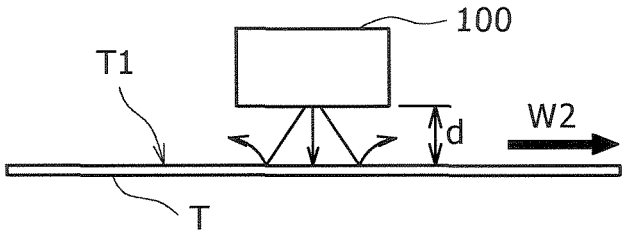
FIG. 10 is a schematic side view showing the relationship between the spacing distance and the deposit removing effect.

As shown in FIGS. 9 and 10, when the compressed air is vertically blown on the top surface T1 of the plate-like member T, the area over the range in which the compressed air collided against the plate-like member (i.e., the area surrounded by a broken line in FIGS. 9 and 10) is represented by W, and the flow speed (average flow speed in the spacing distance d) of compressed air until the compressed air collides against the plate-like member T is represented by V. Then, it is deemed that, the larger the value of $WV^2$, the larger is the force for removing deposit on the top surface T1 of the plate-like member T. Here, letting the quantity of flow of the compressed air jetted from the jetting ports 101 of the nozzle body 100 be Q, $WV^2$ can be represented by the following expression, because an approximation Q≈WV holds.

$$WV^2\approx QV \quad (3)$$

Here, when the quantity of flow Q to be jetted is constant, it is to be easily understood from the expression (3) that, the larger the flow rate, the larger is the force for removing deposit.

In general, when compressed air is jetted from the jetting ports 101 of the nozzle body 100, since its compression pressure is released and the compressed air is radially blown out, the flow speed V decreases as the compressed air gets away from the jetting ports 101. The air intervening in the space corresponding to the spacing distance d causes the reduction in the flow speed V, as a resistance. Therefore, when the flow rate Q is constant, the smaller the spacing distance d, the higher is the flow speed V, thereby increasing the force for removing deposit. For the above-described reason, in this embodiment, the compressed air pressure to be supplied to the nozzle body 100 is set so that the distance $d_0$ becomes 0.1 mm, which is a value close to 0.

Example 1

Figure 11:
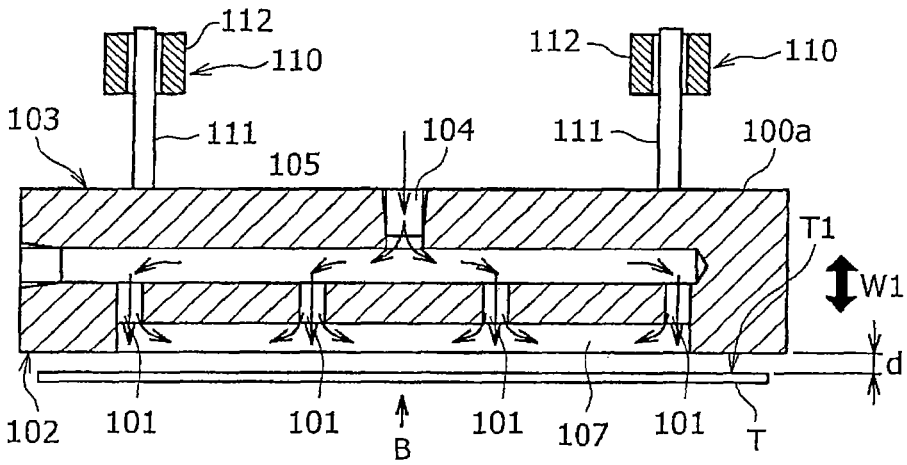
FIG. 11 is a schematic longitudinal sectional view of a nozzle body of a deposit removing device according to an example 1 of the present invention.
Figure 12:
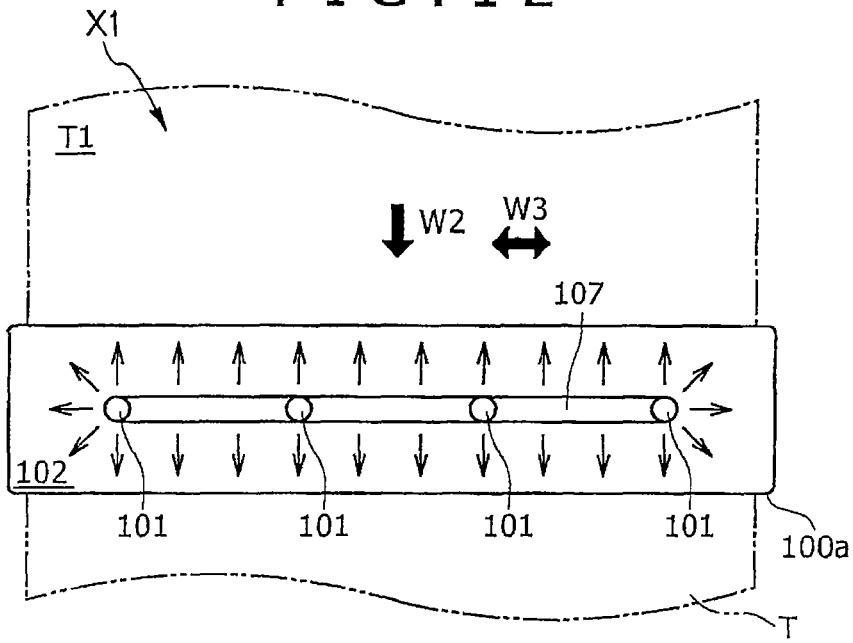
FIG. 12 is an arrow view of the nozzle body as viewed in the direction of B in FIG. 11.

Next, a deposit removing device X1 according to an example 1 of the present invention will be described with reference to FIGS. 11 and 12. FIG. 11 is a schematic longitudinal sectional view of the nozzle body 100*a*, and FIG. 12 is an arrow view of the nozzle body shown in FIG. 11. The same components as those in the above-described embodiment are designated by the same symbols, and descriptions thereof are omitted.

The deposit removing device X1 according to this embodiment is embodied into the deposit removing device X of the above-described embodiment in that, as shown in FIG. 11, and notably in FIG. 12, the deposit removing device X1 uses a nozzle body 100*a* in which the opposed surface 102 facing the top surface T1 has a groove 107. Although, in FIG. 11, grooves 106 (refer to FIGS. 2 to 4) formed in the nozzle body 100 are not shown, the nozzle body 100*a* may include the grooves 106.

As shown in FIG. 11, the groove 107 is formed in the direction perpendicular to the conveying direction W2 (refer to FIG. 12) of the plate-like member T so as to allow the four jetting ports 101 to communicate with one another. This allows compressed air to be jetted from the four jetting ports 101 to be uniformly jetted across the full width of the top surface of the plate-like member, even if the number of the jetting ports 101 is small.

Example 2

Next, a deposit removing device X2 according to an example 2 of the present invention will be described with reference to FIGS. 13 and 14.

Figure 13:
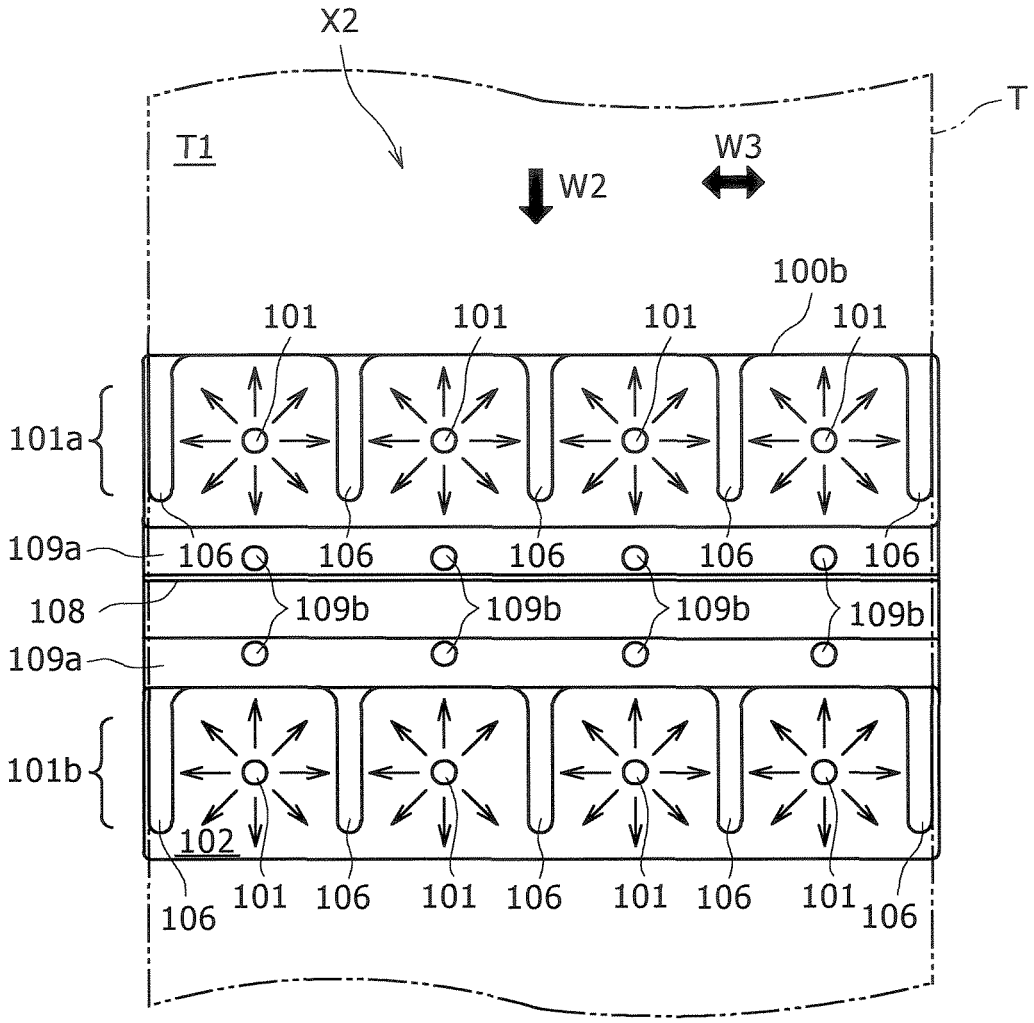
FIG. 13 is a schematic view of a nozzle body of a deposit removing device according to an example 2 of the present invention.

In this example, a nozzle body 100*b* shown in FIG. 13 is used. In the nozzle body 100*b* of the deposit removing device X2, in its opposed surface, there are provided four jetting ports 101 that are arranged at spacings along the direction W3 substantially perpendicular to the conveying direction W2 of the plate-like member T (refer to FIG. 13) of the plate-like member T and the moving direction W1 (refer to FIG. 14) of the nozzle body 100*b*; and further, jetting port train 101*b* substantially same as a jetting port train 101*a* in a group of the above-described four jetting ports are arranged in parallel with the jetting port train 101*a* at predetermined spacings on the downstream side in the conveying direction W2. By juxtaposing such jetting port train 101*a* and jetting port train 101*b*, even when deposit that could not removed by the jetting port train 101*a* remains on the plate-like member T, removal processing of the deposit is performed by the jetting port train 101*b*, thereby allowing the deposit removing effect to be even more improved. As described above, in this example, the nozzle body 100*b* in which two rows of jetting port trains (101*a* and 101*b*) are shown as an example, but the number of rows is not particularly limited to two.

Also, in nozzle body 100*b*, there is provided a planar nozzle 108 having a long opening in the direction W3 substantially perpendicular to the conveying direction W2 of the plate-like member T and the moving direction W1 of the nozzle body 100*b*. The planar nozzle 108 is connected to the communicating path 105 via the communicating path (not shown), and supplies compressed air from the supply port 104 thereto. Forming such a planar nozzle 108 allows the compressed air to be uniformly jetted across the full width of the top surface T1 of the plate-like member T. For the purpose of securing a discharge amount or the like, another air supply source may be connected to the planar nozzle 108.

In order to move the nozzle body 100, 100*a*, or the like to its moving direction W1, the above-described jetting ports 101 are each formed so as to jet compressed air substantially vertically to the plate-like member T. However, the compressed air having been vertically jetted to the plate-like member T solely performs the function of stripping off deposit, and does not perform so much function of blowing off the adhered deposit toward the upstream side in the conveying direction W2 of the plate-like member T. Also, because some of the compressed air jetted flows into the groove 106, a force for stripping off deposit decreases. This being the case, in this example, as shown in FIG. 14, the above-described planar nozzle 108 is provided with a tilt angle in order to cause the compressed air to jet toward the upstream side in the conveying direction of the plate-like member T.

Figure 14:
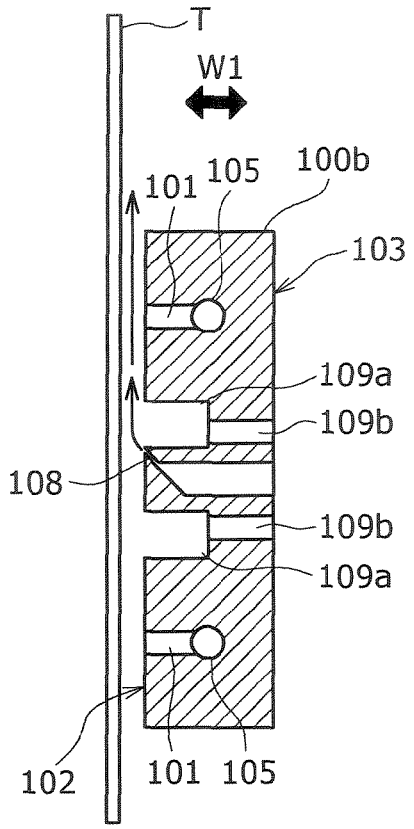
FIG. 14 is a schematic sectional view of the nozzle body of the deposit removing device shown in FIG. 13.

Also, as shown in FIG. 14, in the nozzle body 100*b*, an air reservoir 109*a* (one example of air-reservoir) that retains air jetted from the jetting port 101 and flowing through the space between the opposed surface 102 and the plate-like member T, is formed long along the direction W3. This is intended to accumulate air having deposit stripped off on the opposed surface 102 in order to efficiently remove the stripped-off deposit. On the other hand, on the surface 103 opposite to the opposed surface 102, there is provided an air release hole 109*b* (one example of communicating hole) for guiding the air reservoir 109*a* to the outside in order to release the air in the air reservoir 109*a*.

In this example, a depressed gas-reservoir 109*a* is provided in the opposed surface 102, and the nozzle body 100*b* has the air release hole 109*b* for allowing the inside of the gas reservoir 109*a* to communicate with the outside of the nozzle body 100*b*. As a result, in this example, when compressed gas is jetted to the plate-like member T and the gas reflects from the plate-like member T to thereby collide the opposed surface 102, the compressed gas jetted from the jetting ports 101 is accumulated inside the gas reservoir 109*a*, and gas inside the gas reservoir 109*a* is guided outside the nozzle body 100*b* through the air release hole 109*b*. As a result, in particular, even if the deposit is a viscous material that is prone to adhere to the opposed surface 102, e.g., a viscous material such as oil or dust containing oil, it is possible to reliably prevent the deposit from colliding against the opposed surface 102 and adhering thereto, and to reduce clogging of the jetting ports 101 or re-adhesion of the deposit to the plate-like member T.

There may be provided a blower fan (one example of suction means) connected to the air release hole 109*b* using piping or a flexible hose. Driving the blower fan to suck air in the air reservoir 190*a* through the air release hole 109*b*, allows air that contains deposit to be even more efficiently discharged.

Example 3

Figure 15:
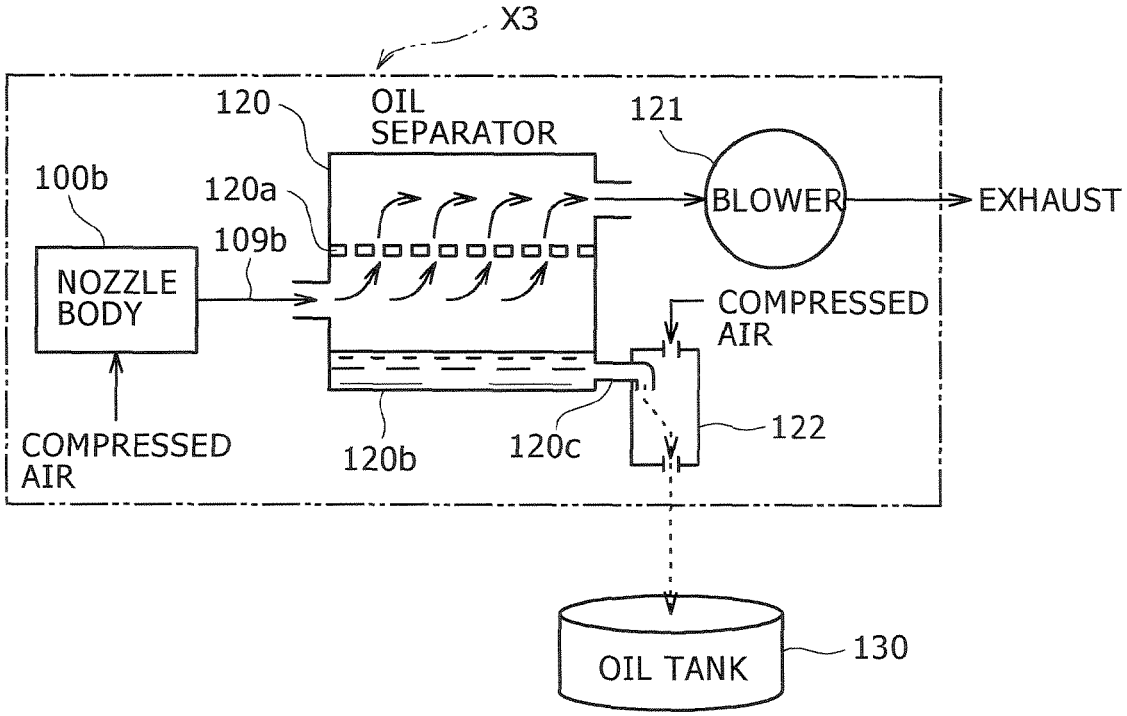
FIG. 15 is a block diagram showing a schematic construction of a deposit removing device according to a third embodiment of the present invention.

Next, an example 3 will be described with reference to FIG. 15 (block diagram). A deposit removing device X3 according to this example is constructed to include the air release hole 109*b* provided in the nozzle body 100*b* (example 2, refer to FIG. 13); an oil separator 120 (one example of deposit separating/recovering means) that separates liquid or misty rolling liquid (one example of liquid deposit) contained in the air discharged from the air release hole 109*b*, from the air, and that recovers it in an oil tank 130 arranged outside the device;

an injector 122 for guiding the separated rolling oil to the oil tank 130. Because other components of the deposit removing device X3 is similar to those of the deposit removing device X2, description thereof herein is omitted.

Possible types of the oil separator include various ones, but here, a device is exemplified that has therein an oil filter 120*a* for separating rolling oil alone from air, and that has a drain layer 120*b* with a drain hole 120*c*, for storing the rolling oil separated by the oil filter 120*a*.

The above-described injector 122 is connected to drain hole 120*c* and used for sucking rolling oil from the drain layer 120*b* and guiding it to the oil tank 130, taking advantage of a negative pressure occurring in the injector 122 by recycling back compressed air supplied from the outside by the injector 122. During operation of the blower 121, in the oil separator 120, air flows along a flow path from the nozzle body 100*b* through the oil filter 120*a* to the blower 121, and a negative pressure caused by this air flow makes it difficult that the rolling oil in the drain layer 120*b* is discharged from the drain hole 120*c*. However, since the deposit removing device X3 has the injector 122, it is possible to forcedly discharge the rolling oil even during operation of the blower 121.

In the deposit removing device X3 with this arrangement, when air discharged from the air release hole 109*b* is fed into the oil separator 120, the rolling oil is separated. The air cleared of the rolling oil is sucked out by the oil separator 120 and discharged outside. On the other hand, the rolling oil separated by the oil filter 120*a* is stored in the drain layer 120*b*. Then, the rolling oil accumulated in the drain layer 120*b* is sucked out from the drain hole 120*c* by the injector 122 and discharged toward the oil tank 130.

If compressed air is supplied all the time, when the rolling oil in the drain layer 120*b* is all discharged, air is undesirably discharged from the drain hole 120*c*. As a result, there occurs a possibility that not only the separation efficiency of rolling oil decreases, but also the blower 121 is subjected to a high load. It is therefore desirable to supply the injector 122 with compressed air intermittently, i.e., at predetermined intervals. Alternatively, the arrangement may be such that a flow switch or the like is provided in the drain layer 120*b* in advance, and that, on the condition that an output signal indicating that a predetermined amount of rolling oil has been stored has been received, a compressed air changeover valve or the like is activated.

In this manner, in the deposit removing device X3, since air and rolling oil are separated, and the rolling oil is recovered in the oil tank 130, air that contains rolling oil does not have to be discharged in the air, thereby allowing damage to human bodies and environment to be eliminated. Since the discharged rolling oil is recovered, the reuse of rolling oil is feasible.

In this example, the case where rolling oil is separated and recovered has been described, but for example, even in the case where liquid deposit other than rolling oil is separated and recovered, the deposit removing device X3 according to this example can be applied.

Also, providing a filter (not shown) that separates solid deposit such as dusts from the discharged air, instead of using the above-described oil filter, allows solid deposit to be separated and recovered.

Example 4

Figure 16:
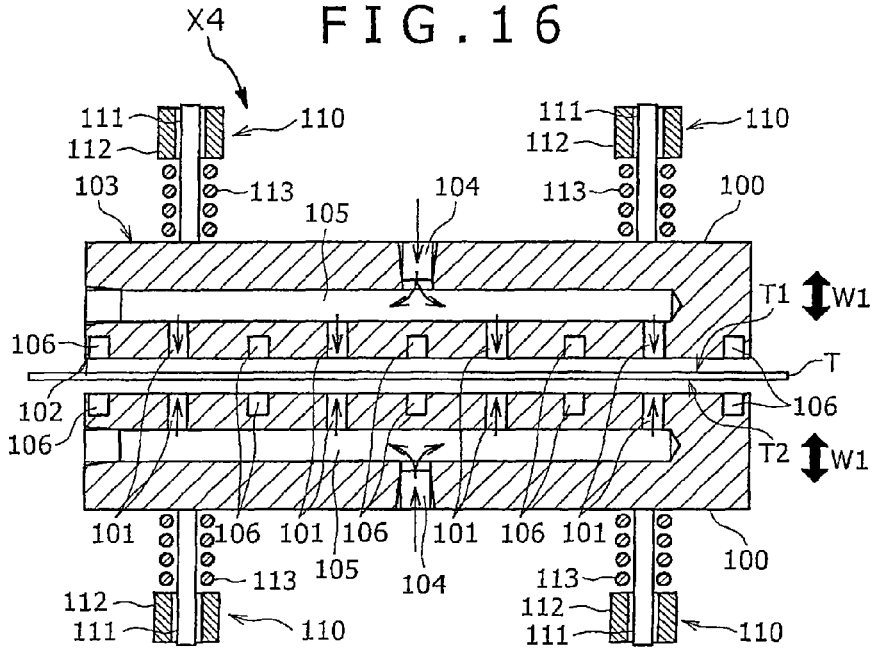
FIG. 16 is a schematic view showing a nozzle body of a deposit removing device according to a fourth embodiment of the present invention.

Next, an example 4 of the present invention will be described with reference to FIG. 16. In a deposit removing device X4 according to this example, the same nozzle body 100 as that in the above-described embodiment is provided not only on the top surface T1 of the plate-like member T, but also on the bottom surface T2. When the nozzle body 100 is disposed on the bottom surface T2 on the plate-like member T, the nozzle body 100 must be arranged so that compressed air is jetted toward a direction opposite to the direction in the case where the nozzle body 100 is disposed on the top surface T1. Such being the case, in this case, as shown in FIG. 16, in order to prevent the nozzle body 100 from moving downward by its own weight, and to support the nozzle body 100 so as to be movable in the direction W substantially perpendicular to the bottom surface T2 of the plate-like member T, the nozzle body 100 is supported by elastic members 113 such as helical springs. Such an arrangement makes it possible not only to remove deposit on both surfaces of the plate-like member T, but also to prevent the nozzle body 100 from overshooting or undershooting in the up-and-down direction, and hunting.

Example 5

A deposit removing device X5 according to an example 5 of the present invention described here is constructed so as to maintain buoyancy of the nozzle body 100.

Figure 17:
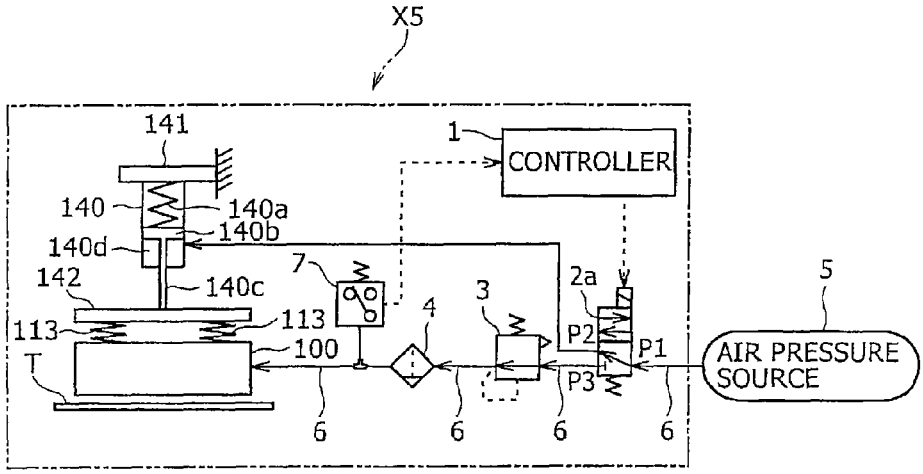
FIG. 17 is a circuit diagram showing a schematic construction of a deposit removing device according to a fifth embodiment of the present invention.

Specifically, as shown in the circuit diagram in FIG. 17, in addition to the above-described pressure reducing valve 3, air filter 4, controller 1, and nozzle body 100, the deposit removing device X5 is constructed to include a pressure switch 7 set to a set operating pressure value that has been predetermined (specified pressure value), and a cylinder 140 (one example of drive means) that operates by being supplied with compressed air. Unlike the construction of any of the above-described embodiment and examples, a three-way solenoid valve 2*a*, which allows three-way switching, is used in place of the above-described solenoid valve 2.

The above-described cylinder 140 is a single-acting cylinder having therein an elastic member 140*a* such as a spring, and a piston 140*b*. When compressed air having a pressure not lower than a predetermined pressure (air pressure allowing the piston 140*b* to exert at least a force higher than an energization force by the elastic member 140*a*) is supplied to an air supply chamber 140*d*, the above-described piston 140*b* operates in a direction opposite to that of the energization force of the elastic member 140*a*. This cylinder 140 is installed to a support member 141 so that the piston 140*b* operates in a vertical direction, and that the piston 140*b* operates in an upward direction under the supply of the compressed air.

Also, a piston shaft 140*c* extending under the piston 140*b* is connected to a support member 142 for supporting the nozzle body 100 via the above-described elastic member 113 (refer to FIG. 16). With such a connection provided, when the piston 140*b* operates, the nozzle body 100 is lifted in a direction substantially perpendicular to the surfaces of the plate-like member T.

The above-described solenoid valve 2*a* is a three-way solenoid valve having one input port and two output ports, and its input port P1 is pipe-connected to the air pressure source 5. On the other hand, out of the two output ports, a port P2 that communicates with the air pressure source 5 under demagnetization is pipe-connected to the air supply chamber 140*d* of the cylinder 140, while a port P3 that communicates with the air pressure source 5 under magnetization is pipe-connected to the pressure reducing valve 3.

The pressure switch 7 transmits a detection signal to the controller 1 when the pressure of compressed air becomes lower than a specified pressure that has been predetermined. This specified pressure is a minimum pressure required for levitating the nozzle body 100.

In the present deposit removing device X5 with such an arrangement, when the detection signal is outputted from the pressure switch 7 to the controller 1 in the process of the floating (levitating) of the nozzle body 100 under the supply of compressed air, the three-way solenoid valve 2*a* is demagnetized by the controller 1. In response to this, the three-way solenoid valve 2*a* operates, the output port P3 is closed, and output port P2 is opened. Thereafter, compressed air is supplied to the air supply chamber 140*d* via the output port P2. Here, the controller 1, which controls the three-way solenoid valve 2*a* as described above, corresponds to the drive control means.

In the cylinder 140, when compressed air is supplied to the air supply chamber 140*d*, the piston 140*b* moves upward, and the nozzle body 100 is lifted upward as the result of the movement of the piston 140*b*.

In this way, when the pressure of compressed gas supplied to the nozzle body 100 becomes lower than the specified pressure, since the nozzle body 100 is lifted by the cylinder 140, the plate-like member T is protected from failure due to the fall of the nozzle body 100.

In this example 5, the case where the nozzle body 100 is disposed on the top surface side of the plate-like member T has been explained, but of course, as described in the above-described example 4, the present invention is likewise applicable when the nozzle body 100 is disposed on the bottom surface of the plate-like member T. Meanwhile, in this case, the cylinder 140 is arranged so as to lower the nozzle body 100 downward from the bottom surface by an operation of the piston 140*b*.

In this example, the instance in which a single-acting cylinder is used as drive means has been explained, but, for example, a double-acting cylinder may be used.

As stated above, the present invention is incorporated into the deposit removing device that removes deposit adhered to the plate-like member by jetting compressed gas from at least one jetting hole of the nozzle body in which the at least one jetting hole is formed. Since this deposit removing device is configured so that the nozzle body is supported so as to be movable in a direction substantially perpendicular to the surfaces of the plate-like member, it is possible to allow the nozzle body to float in a state of being always spaced apart from the plate-like member by a substantially fixed distance. By virtue of this arrangement, even if the surface of the plate-like member are moved up and down by vibrations occurring to the plate-like member or deformation, such as warpage, of the plate-like member, the nozzle body moves up and down following the up-and-down movements of the plate-like member, so that the spacing distance from the surface of the plate-like member to the nozzle body are always kept at a fixed value. As a result, it is possible to set the distance between the plate-like member and the nozzle body to several millimeters or less, and specifically, to be on the level of 0.1 millimeters. Hitherto, because the spacing distance has been set to several millimeters, a sufficient deposit removing effect has not been obtainable unless compressed gas with a relatively high pressure is supplied. However, according to the present invention, by further reducing the spacing distance, it is possible to obtain the deposit reducing effect that is equivalent to or larger than the conventional deposit removing device, even using compressed gas with a lower pressure. Especially when a plurality of the jetting ports are used, a plurality of acting forces on the nozzle body due to the jetting pressure of compressed gas strike balance therebetween, so that this balance allows the nozzle body to more stably float in a state of being always spaced apart from the plate-like member by a substantially fixed distance.

Also, by reducing the distance between the plate-like member and the nozzle body, the jetting pressure of compressed gas jetted to the plate-like member T increases, which makes it possible to remove deposit on the plate-like member rolled by a rolling machine at high speed, i.e., the plate-like member conveyed at a high speed.

Furthermore, since the depressed gas-reservoir is provided in the opposed surface, and the communicating hole is formed in the nozzle body, gas that contains deposit in the gas reservoir is discharged outside, thereby allowing a reduction in clogging of the jetting port or re-adhesion of the deposit to the plate-like member.

Moreover, since gas in the gas reservoir is forcedly sucked and discharged by the suction means, it is possible to efficiently discharge gas that contains deposit.

Also, since there is provided the deposit separating/recovering means, it is prevented that deposit discharged from the communicating hole from being dispersed in the air, thereby implementing a deposit removing device that is friendly to human bodies and the environment. It is also prevented that the discharge deposit re-adheres to the plate-like member.

Furthermore, since the separating/recovering means separates and recovers liquid deposit alone from gas that contains deposit, if the liquid deposit is reusable one such as oil or cleaning liquid, it can be exclusively recovered and reused.

Since the drive means and drive control means are provided, the nozzle body is forcedly separated from the plate-like member before the nozzle body collides against the plate-like member, thereby protecting the plate-like member from failure.

INDUSTRIAL APPLICABILITY

The present invention is preferably used in the industry as a technique for removing rolling oil or cleaning liquid adhered to the plate-like member after rolling, when a plate-like member such as a metal plate or resin plate is manufactured by a rolling machine.

The invention claimed is:

1. A deposit removing device for removing a deposit adhered to a plate-like member being conveyed in a conveying direction, the deposit removing device comprising:

a nozzle body positioned to have an opposed surface facing the surface of a plate-like member being conveyed relative to the nozzle body in the conveying direction, wherein the nozzle body is supported so as to be movable in a direction substantially perpendicular to the surfaces of the plate-like member;

a jetting port formed in the opposed surface of the nozzle body;

a source of compressed gas connected to fluidically communicate with the jetting port, whereby compressed gas will be jetted from the jetting port to remove deposits adhered to the plate-like member; and a groove in the opposed surface of the nozzle body and crossing the position of the jetting port from downstream to upstream, and reaching the upstream edge of the opposed surface in the conveying direction, whereby the groove is oriented to guide the jetted compressed gas from the jetting port to the upstream side of the opposed surface, in the conveying direction of the plate-like member.

2. The deposit removing device according to claim 1, wherein the jetting port is configured so that the total area of the jetting port is smaller than two thirds the area of the opposed surface.

3. The deposit removing device according to claim 1, wherein a plurality of the jetting ports are arranged spaced apart from each other in a direction substantially perpendicular to the conveying direction of the plate-like member.

4. The deposit removing device according to claim 1, wherein a main member constituting the nozzle body is made of a plastic material.

5. The deposit removing device according to claim 1, wherein the nozzle body is disposed on at least one of the top surface side and the bottom surface side of the plate-like member.

6. The deposit removing device according to claim 1, wherein the nozzle body is elastically supported.

7. The deposit removing device according to claim 1, wherein a depressed gas-reservoir is provided in the nozzle body; and wherein the nozzle body has a communicating hole for allowing the inside of the gas reservoir to communicate with the outside of the nozzle body.

8. The deposit removing device according to claim 7, further comprising suction means for sucking gas in the gas reservoir through the communicating hole.

9. The deposit removing device according to claim 7, further comprising deposit separating/recovering means for separating and recovering deposit contained in the gas discharged from the communicating hole.

10. The deposit removing device according to claim 9, wherein the separating/recovering means separates and recovers liquid deposit alone from the gas that contains deposit.

11. The deposit removing device according to claim 1, wherein the groove extends parallel to the conveying direction of the plate-like member.

12. The deposit removing device according to claim 1, wherein the groove is tilted at an angle with respect to the conveying direction of the plate-like member.

13. The deposit removing device according to claim 12, wherein the angle of the groove tilts, as the groove approaches the upstream end of the opposed surface, in a direction toward a longitudinal end of the nozzle body.

14. The deposit removing device according to claim 1, further comprising a plurality of the jetting ports arranged substantially perpendicular to the conveying direction of the plate-like member, wherein, in the opposed surface, there is provided a planar nozzle having a long opening in the direction substantially perpendicular to the conveying direction of the plate-like member and the moving direction of the nozzle body, the long opening joining at least two of the plurality of jetting ports.

15. The deposit removing device according to claim 1, further comprising:

drive means that is connected to the nozzle body, and that moves the nozzle body in the direction substantially perpendicular to the surfaces of the plate-like member; and drive control means that moves the nozzle body in a direction away from the plate-like member by drive-controlling the drive means, when the pressure of the compressed gas supplied to the nozzle body becomes lower than a specified pressure that has been predetermined.

* * * * *